US008720073B1

(12) United States Patent
Gordon

(10) Patent No.: US 8,720,073 B1
(45) Date of Patent: May 13, 2014

(54) DOOR TOOL

(71) Applicant: Maurice Gordon, Denver, CO (US)

(72) Inventor: Maurice Gordon, Denver, CO (US)

( * ) Notice: Subject to any disclaimer, the term of this patent is extended or adjusted under 35 U.S.C. 154(b) by 0 days.

(21) Appl. No.: 13/875,274

(22) Filed: May 1, 2013

(51) Int. Cl.
*E04F 21/00* (2006.01)
*G01B 5/25* (2006.01)

(52) U.S. Cl.
USPC ..... 33/194; 3/474

(58) Field of Classification Search
USPC ..... 33/194, 197, 474, 476, 481, 613, 645
See application file for complete search history.

(56) References Cited

U.S. PATENT DOCUMENTS 1,097,393 A * 5/1914 Mahlstadt ..... 33/481
1,196,519 A * 8/1916 Caylor ..... 33/476
2,803,062 A * 8/1957 Dutcher ..... 33/474
3,623,232 A * 11/1971 Criswell ..... 33/474
6,341,427 B1 * 1/2002 Tepley ..... 33/194
2007/0024552 A1 * 2/2007 Shimizu et al. ..... 345/87
2009/0013346 A1 * 1/2009 Han ..... 725/28
2012/0255182 A1 * 10/2012 Kato ..... 30/347
2013/0219727 A1 * 8/2013 Schmidt ..... 33/481

* cited by examiner

*Primary Examiner* — G. Bradley Bennett

(57) ABSTRACT

A multi-purpose door tool is designed specifically for door installation and repair. The door tool has a general "L" shape incorporating a plurality of level-indicating devices as well as measuring indicia, reference information, wedges, and lifting devices. It is also relatively small and can be produced inexpensively while remaining relatively durable and robust. The door tool can be used on a door and/or door frame to make them square and plumb; lift, wedge, and space them; check vertical and horizontal positioning and leveling; and determine appropriate measurements, locations, setbacks, etc. for door-related hardware. All of these tasks can now be accomplished with a single door tool instead of the plethora of tools formerly required to carry out all of these tasks.

20 Claims, 5 Drawing Sheets

DOOR TOOL

CROSS-REFERENCE TO RELATED APPLICATIONS

This application claims the benefit of U.S. Provisional Application No. 61/687,840 entitled DOOR TOOL and filed on May 1, 2012, which is specifically incorporated by reference herein for all that it discloses and teaches.

TECHNICAL FIELD

The invention relates generally to residential and commercial construction, and more particularly to a door tool that simplifies the process of installing and/or repairing doors.

BACKGROUND

Many years ago, doors in dwellings, businesses, etc. were often custom creations designed to fit the particular size and shape opening already present in a given wall. Eventually, a few standard sized and shaped doors were selected and wall openings began being built to accommodate pre-made, generic doors that could fit certain sized and shaped openings. Today, many doors can be purchased pre-assembled and pre-hung on a door frame. The framer or construction worker simply builds an opening in a wall of a certain size and shape and then ensures that the proper standard door and frame are selected and purchased for that opening. Although this is a much more streamlined and efficient means of building, buying, and installing doors, a significant amount of work and skill are still required to properly install the pre-assembled and/or pre-hung door into the standard wall opening.

In fact, not only does the construction worker that is tasked with installing doors need to be more skilled than a general worker, but he or she must also have a number of additional tools at hand in order to perform the door installation and/or repair. For example, it is common in the art for a door installation person to utilize a pry bar, a lifting bar, one or more levels, a plumb bob, one or more measuring devices, a reference paper/book, shims, and a number of squares and/or triangles. Because of the these extra tools, the relatively skilled type of construction worker required for door installation and/or repair, and the extra work time required, buildings with a larger number of doors will have a significantly higher cost of construction versus standard buildings.

What is needed is a tool that simplifies the installation and/or repair of doors so that a significantly fewer number of tools need to be employed and so that the job of installing and/or repairing doors can be done more quickly and easily.

SUMMARY

One embodiment of the present invention comprises a multi-purpose door tool that is designed specifically for door installation and repair. The door tool is shaped somewhat like a standard carpenter's square or triangle; but in many ways, it is quite different from such known devices. From above, the door tool initially appears as a combination of both a carpenter's square and a triangle. It incorporations a plurality of level-indicating devices (e.g., level bubbles) as well as measuring indicia, reference information, wedges, and lifting devices. It is also relatively small and can be produced inexpensively while remaining relatively durable and robust.

The door tool can be used on a door and/or door frame to make them square and plumb; lift, wedge, and space them; check vertical and horizontal positioning and leveling; and determine appropriate measurements, locations, setbacks, etc. for door-related hardware. All of these tasks can now be accomplished with a single door tool instead of the plethora of tools formerly required to carry out all of these tasks.

DETAILED DESCRIPTION

Figure 1:
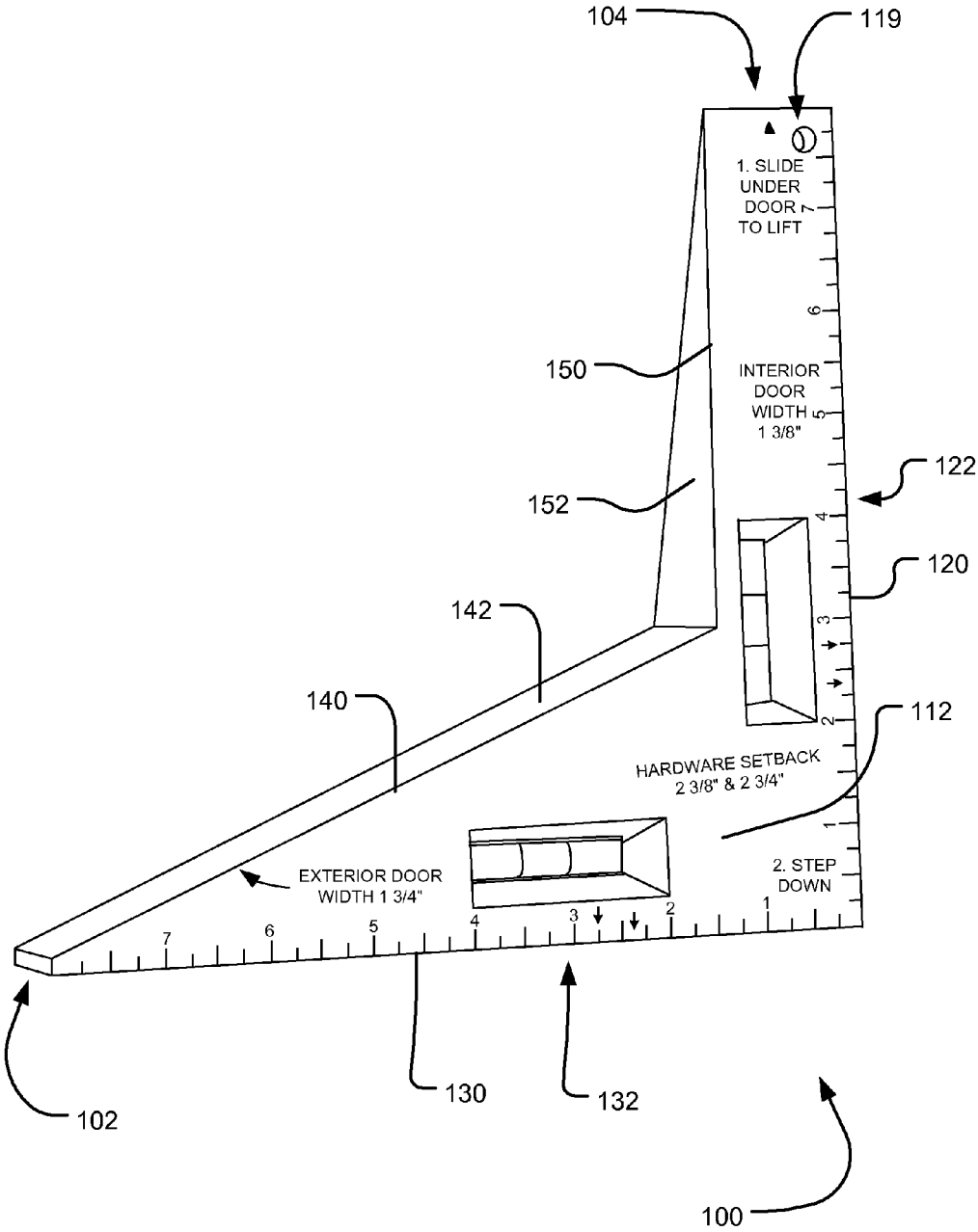
FIG. 1 shows a perspective view of the front face of an exemplary embodiment of a door tool.

In the following discussion, numerous specific details are set forth to provide a thorough understanding of the present disclosure. However, those skilled in the art will appreciate that embodiments may be practiced without such specific details. Furthermore, lists and/or examples are often provided and should be interpreted as exemplary only and in no way limiting embodiments to only those examples.

Exemplary embodiments are described below in the accompanying Figures. The following detailed description provides a comprehensive review of the drawing Figures in order to provide a thorough understanding of, and an enabling description for, these embodiments. One having ordinary skill in the art will understand that in some cases well-known structures and functions have not been shown or described in detail to avoid unnecessarily obscuring the description of the embodiments.

Referring now to the drawings, FIG. 1 shows a perspective view of the front face 112 of an exemplary embodiment of a door tool 100. The front face 112 is bounded on the bottom by the bottom edge 130 and the bottom face 132, on the right side by the right edge 120 and the right face 122, on the left by the left edge 150 and the left face 152 and on the top and left by the angled edge 140 and angled face 142. Additionally, there can be a small face on the left called the left point 102 and a small face on the top called the top point 104 (not shown in FIG. 1, but it can approximately mirror the left point 102 in size and shape). The back face and other edges and surfaces are described in more detail in the other FIGs. below.

The bottom edge 130 and the right edge 120 form approximately a ninety degree angle, as do the bottom face 132 and the right face 122. The front face 112 and the right face 122 form a right angle along the right edge 120. The front face 112 and the bottom face 132 also form a right angle along the bottom edge 130. The front face and the angled face 142 form an approximate right angle (this is preferred, but not strictly necessary) along the angled edge 140. The front face 112 and the left face 152 form an approximate right angle (again, this is preferred, but not strictly necessary) along the left edge 150. The top point 104 is preferably at a right angle to the front face 112 and the left point 102 is preferably at a right angle to the front face 112 as well.

Figure 2:
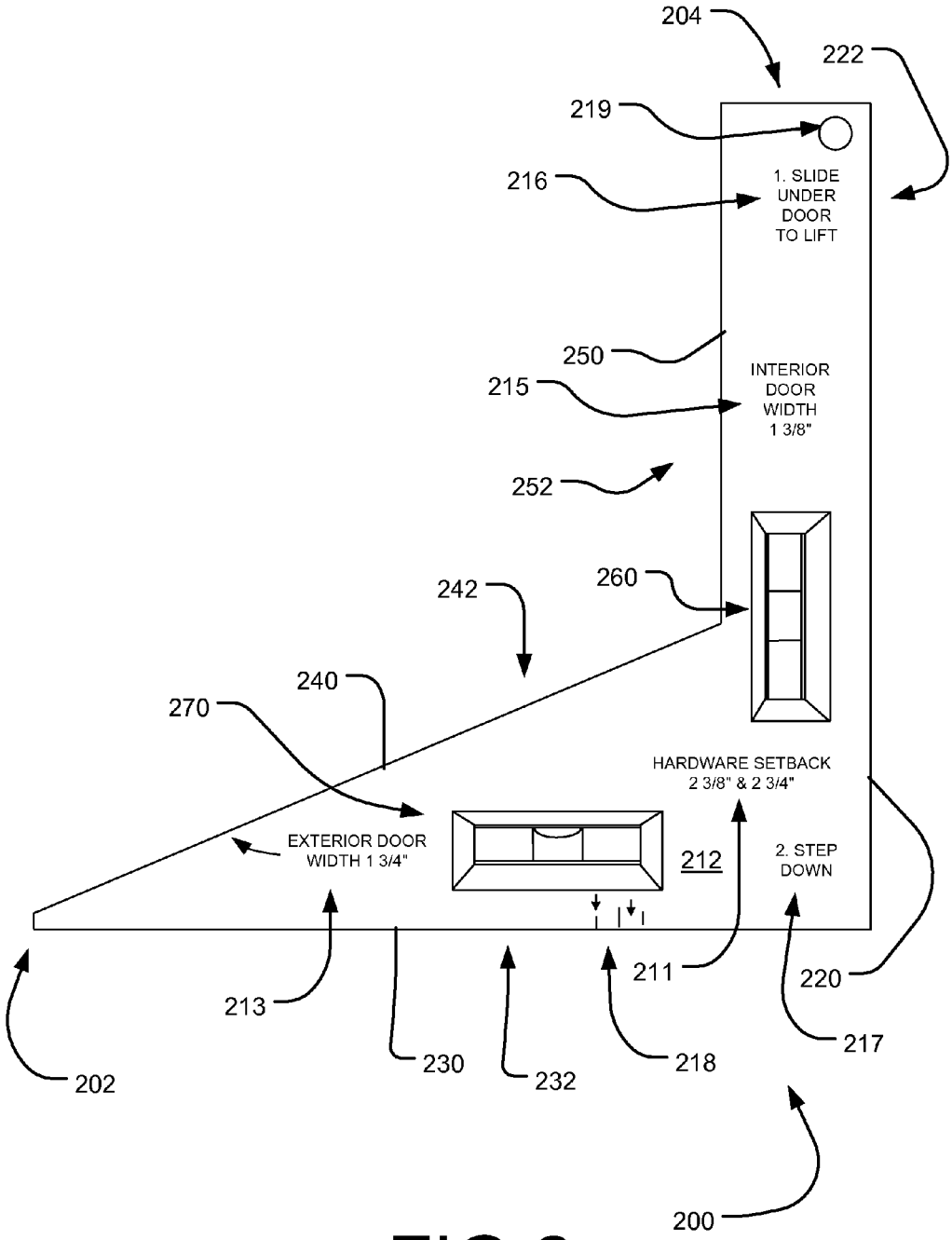
FIG. 2 illustrates a front elevation view of an exemplary embodiment of a door tool.

Located within the front face 112 are a plurality of level indicating devices, they are not labeled in FIG. 1, instead look for more information in FIG. 2. In the exemplary embodiment illustrated in FIG. 1, a number of measuring indicia are displayed. It is preferred to have a first measuring indicia beginning where the right edge 120 meets the bottom edge 130 and running along the bottom edge 130. It is also preferred to have a second measuring indicia beginning where the right edge 120 meets the bottom edge 130 and running along the right edge 120. Although the measuring indicia in FIG. 1 is shown in quarters of inches increments, smaller or larger increments are contemplated as are other units of measurement such as millimeters, centimeters, etc. Additional indicia are illustrated, but not labeled and described until later FIGs. Also, see the descriptions below for more detail on the wedging and lifting shapes that are incorporated into the door tool.

The hanging means 119 illustrated in FIG. 1 is a small hole, other hanging means are contemplated.

FIG. 2 illustrates a front elevation view of an exemplary embodiment of a door tool 200. Illustrated in FIG. 2 are the left point 202, top point 204, hardware setback indicia 211, front face 212, exterior door indicia 213, interior door indicia 215, lifting step one indicia 216, lifting step two indicia 217, a plurality of measurement highlights 218, a hanging means 219, and all the surfaces and edges discussed above under FIG. 1. Additionally, a first level indicating device 260 and a second level indicating device 270 are illustrated in FIG. 2. The measuring indicia shown in FIG. 1 is not illustrated again in its entirety in FIG. 2 in order to highlight other features of the door tool.

The right angle relationship between the right edge 220 and the bottom edge 230 is more clear in FIG. 2. Also, the left face 252, right face 222, bottom face 232, angled face 242, left point 202 and top point 204 are indicated, but not directly visible in FIG. 2.

The hardware setback indicia 211 illustrate exemplary indicia describing standard hardware setback measurements. In the example of FIG. 2, the measurements are two and three eighths inches, two and one half inches, and two and three quarters inches. The exterior door indicia 213 indicates a preferred exterior door width of one and three quarters inches and points to the proper position relative to that measurement on the door tool. The interior door indicia 215 indicates a preferred interior door width of one and three eighths inches.

The lifting step one indicia 216 informs the user that a door, door frame, or other material can be lifted by first placing the top point 204 under the item to be lifted, while the lifting step two indicia 217 informs the user that the second step in the lifting process is to step down on the lifting step two indicia 217. This causes the door tool to act as a lever (see FIGS. 3 and 4 for more detail on how this works) and lift the top point 204 upwards causing the door, door frame, etc. to lift upwards as well.

The first level indicating device 260 and the second level indicating device 270 are illustrated in FIG. 2 as being the standard bubble level devices. When the nearest full straight edge 220 or 230 relative to the given level indicating device 260 or 270 is horizontally level, the bubble in the level indicating device 260 or 270 will be exactly spaced between the center lines therein. If the bubble is to the left of center, the left end of the edge 220 or 230 is above the horizontal relative to the right end of the edge 220 or 230, respectively. Similarly, if the bubble is to the right of center, the right end of the edge 220 or 230 is above the horizontal relative to the left end of the edge 220 or 230, respectively.

Figure 3:
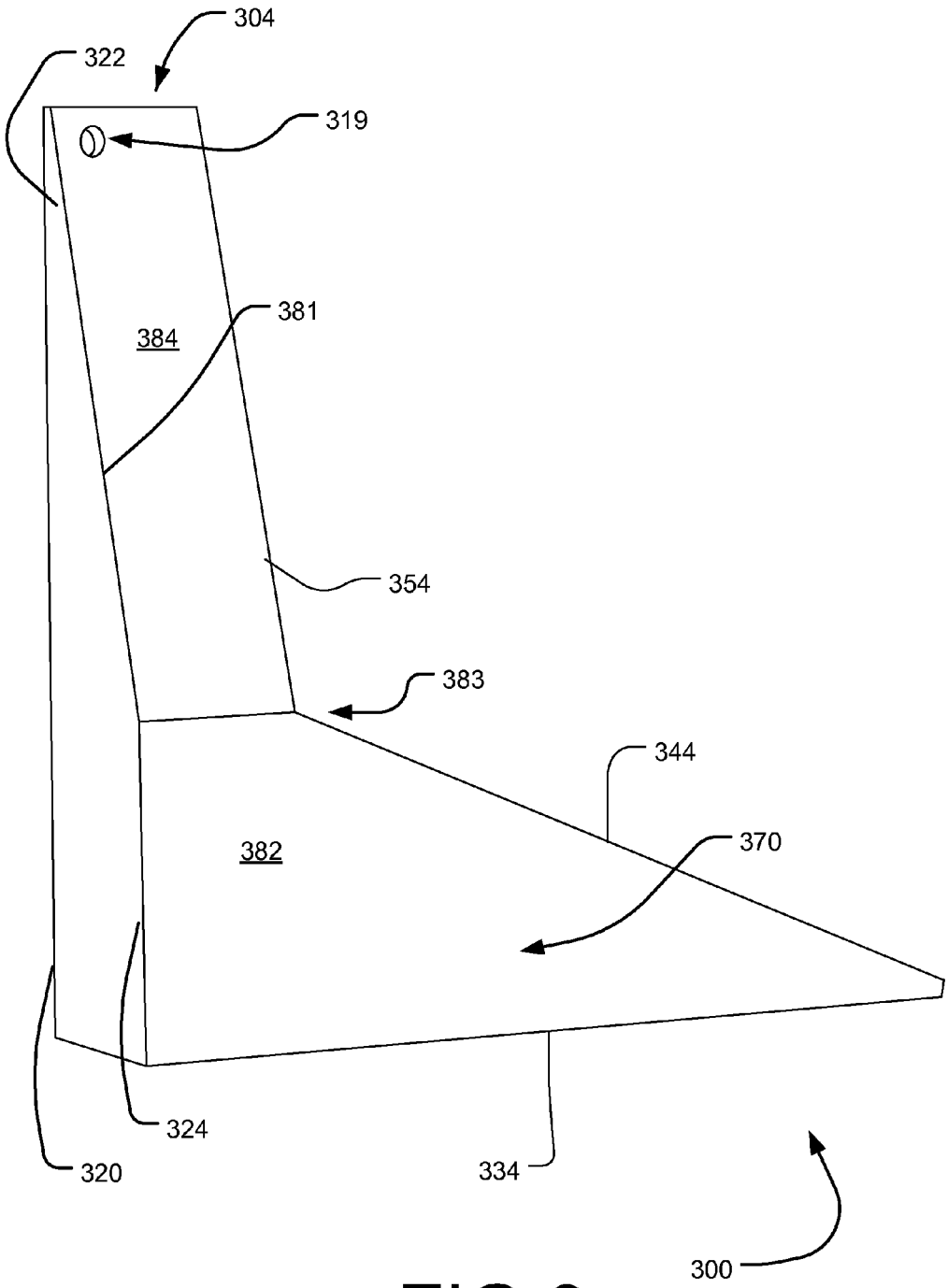
FIG. 3 illustrates a perspective view of the back face of an exemplary embodiment of a door tool.

FIG. 3 illustrates a perspective view of the back face 382 of an exemplary embodiment of a door tool 300. The back face 382 is parallel to the front face 212 (see FIG. 2) and forms a right angle relative to the right face 322 along the right back edge 324; a right angle relative to the bottom face 232 (see FIG. 2) along the bottom back edge 334; and a right angle relative to the angled face 242 (see FIG. 2) along the angled back edge 344. The wedge face 384 also forms a right angle to the right face 322 along the right wedge edge 381, it forms a right angle to the left face 252 (see FIG. 2) along the left wedge edge 354.

Also illustrated in FIG. 3 are the hanging means 319 and the top point 304. Although not shown in FIG. 3, a number of cut-out spaces could be incorporated as weight saving features. Additionally, the windows in the front of the door tool could also be incorporated in the rear so that the plurality of level indicating devices can be viewed from this side as well.

The line of contact between the wedge face 384 and the back face 382 is indicated by the back face angle edge 383. The angle formed between the wedge face 384 and the back face 382 creates the shape that is necessary for the levering/lifting functionality of the door tool as described above. The user simply places the top point 304 under the object that is desired to be lifted with the wedge face 384 on the ground, and then steps down on the bottom edge 230 near the junction of the bottom edge 230 and the right edge 320. This causes the back face angle edge 383 to act as a lever and lifts the top point 304 upwards thereby lifting the object as well. The wedge face 384 and the top face 212 can also act in concert to wedge apart two items simply by inserting the top point 304 between the two items and pushing the door tool into the gap. This action will automatically spread the two items apart (assuming they were not already too far apart and that they can be moved apart by such manual forces/means).

Figure 4:
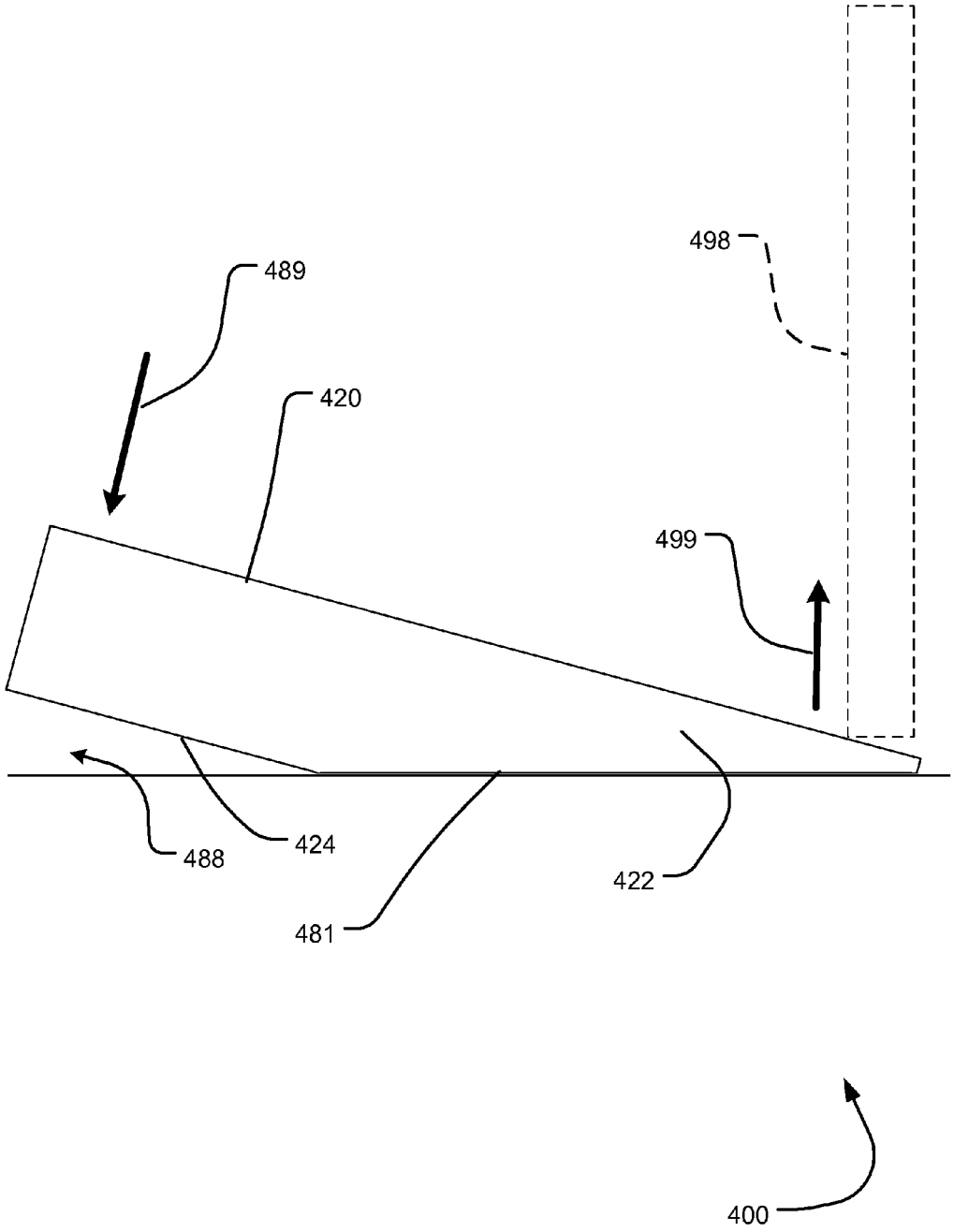
FIG. 4 illustrates a right side elevation view of an exemplary embodiment of a door tool being employed on a door frame to lift it into position.

FIG. 4 illustrates a right side elevation view of an exemplary embodiment of a door tool 400 being employed on a door frame 498 to lift it into position. Also shown are the right edge 420, the right back edge 424, the right wedge edge 481, and the right face 422. The door frame 498 is shown in dashed lines. As can be seen in FIG. 4, the top point is placed under the door frame 498 with the wedge face against the floor. The bottom back edge is then forced off the floor by the shape of the door tool 400 creating a gap 488 between the floor and the bottom back edge. Application of downwards pressure on the bottom edge near where the bottom edge meets the right edge and in the direction indicated by the arrow 489 will cause the bottom back edge of the door tool 400 to approach the floor and the lever action will cause the top point and wedge face to lift off of the floor thereby lifting the door frame 498.

In addition to the lifting feature of the door tool 400, the tool 400 can also be used to square a door frame. Each upper corner of a standard door frame should come together in the corner at a ninety degree angle (or right angle). By placing the bottom face of the door tool 400 against the inside top surface of a door frame and the right face against an inside upright surface of a door frame, the proper angle of ninety degrees can be visualized and the two door frame pieces can be repositioned to bring them to the proper angle relative to each other.

Figure 5:
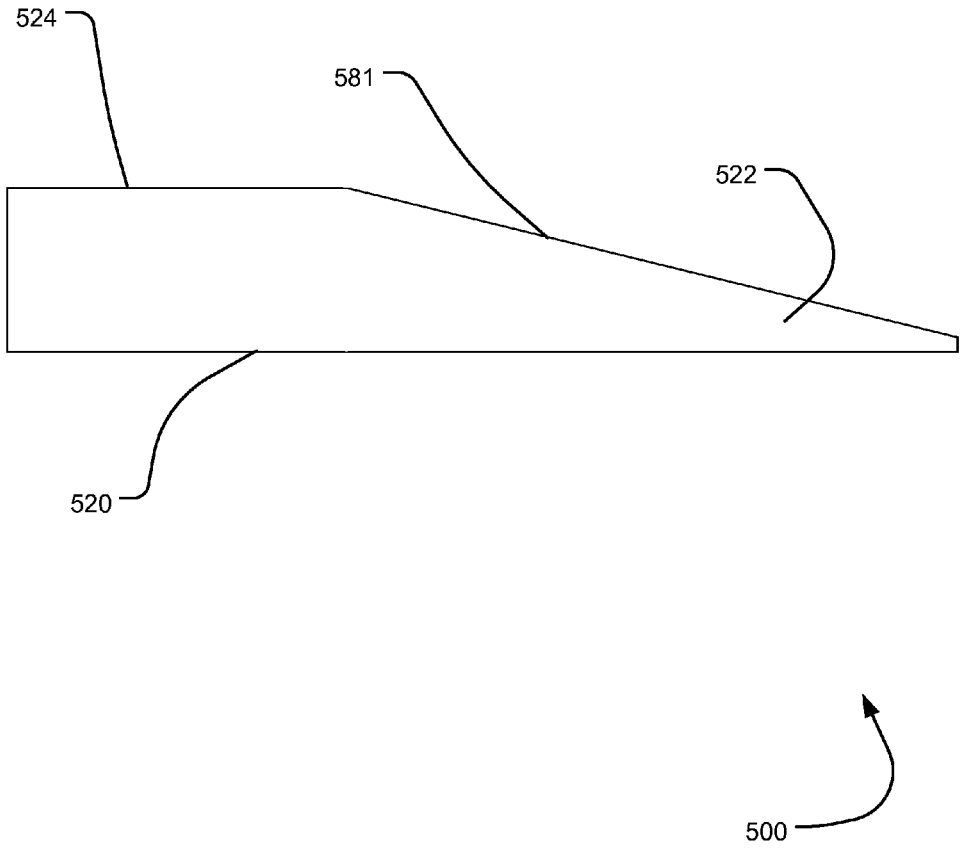
FIG. 5 illustrates a right side elevation view of an exemplary embodiment of a door tool.

FIG. 5 illustrates a right side elevation view of an exemplary embodiment of a door tool 500. The components illustrated include the right edge 520, the right back edge 524, the right wedge edge 581, and the right face 522. In addition to the squaring feature of the door tool 500, the tool 500 can also be used to plumb a door frame. An upper corner of a door frame can be defined by a hinge upright frame piece and by a top crosspiece. They should come together in the corner at a ninety degree angle (or right angle) and it should be plumb. By placing the bottom face against a door in the frame and the right face against the hinge upright frame piece, such can be verified or the components can be moved as necessary.

In addition to the plumb feature of the door tool 500, the tool 500 can also be employed on a door to mark it for installation of door-related hardware. The door tool 600 is placed with the bottom surface against a door and the measuring indicia along the bottom edge (see FIG. 1) can then indicate the proper place to mark the door for installation of door related hardware.

While particular embodiments have been described and disclosed in the present application, it is clear that any number of permutations, modifications, or embodiments may be made without departing from the spirit and the scope of this disclosure.

Particular terminology used when describing certain features or aspects of the embodiments should not be taken to imply that the terminology is being redefined herein to be restricted to any specific characteristics, features, or aspects with which that terminology is associated. In general, the terms used in the following claims should not be construed to be limited to the specific embodiments disclosed in the specification, unless the above Detailed Description section explicitly defines such terms. Accordingly, the actual scope of the claims encompasses not only the disclosed embodiments, but also all equivalent ways of practicing or implementing the claimed subject matter.

The above detailed description of the embodiments is not intended to be exhaustive or to limit the disclosure to the precise embodiment or form disclosed herein or to the particular fields of usage mentioned above. While specific embodiments and examples are described above for illustrative purposes, various equivalent modifications are possible within the scope of the disclosure, as those skilled in the relevant art will recognize. Also, the teachings of the embodiments provided herein can be applied to other systems, not necessarily the system described above. The elements and acts of the various embodiments described above can be combined to provide further embodiments.

Any patents, applications and other references that may be listed in accompanying or subsequent filing papers, are incorporated herein by reference. Aspects of embodiments can be modified, if necessary, to employ the systems, functions, and concepts of various references to provide yet further embodiments.

In light of the above "Detailed Description," the Inventor may make changes to the disclosure. While the detailed description outlines possible embodiments and discloses the best mode contemplated, no matter how detailed the above appears in text, embodiments may be practiced in a myriad of ways. Thus, implementation details may vary considerably while still being encompassed by the spirit of the embodiments as disclosed by the inventor. As discussed herein, specific terminology used when describing certain features or aspects should not be taken to imply that the terminology is being redefined herein to be restricted to any specific characteristics, features, or aspects of the embodiments with which that terminology is associated.

While certain aspects are presented below in certain claim forms, the inventor contemplates the various aspects in any number of claim forms. Accordingly, the inventor reserves the right to add additional claims after filing the application to pursue such additional claim forms for other aspects.

The above specification, examples and data provide a description of the structure and use of exemplary implementations of the described articles of manufacture and methods. It is important to note that many implementations can be made without departing from the spirit and scope of the invention.

What is claimed is:

1. A door tool, comprising:

a front face having a perimeter bounded by a bottom edge, a right edge, a left edge, an angled edge, a left point and a top point;

wherein the bottom edge and the right edge form a ninety degree angle;

wherein the top point and the right edge form a ninety degree angle;

wherein the top point and the left edge form a ninety degree angle;

wherein the left edge abuts the angled edge;

wherein the angled edge abuts the left point;

wherein the left point and the bottom edge form a ninety degree angle;

a bottom face, and a right face;

wherein the front face and the right face form a right angle along the right edge;

wherein the front face and the bottom face form a right angle along the bottom edge;

wherein the front face and the angled face form an approximate right angle along the angled edge;

wherein the front face and the left face form an approximate right angle along the left edge;

wherein within the front face are a plurality of level indicating devices, said level indicating devices being viewable by a user looking at the front face;

a back face parallel to the front face;

wherein the back face and the right face form a right angle along a right back edge;

wherein the back face and the bottom face form a right angle along a bottom back edge;

wherein the back face and the angled face form a right angle along an angled back edge;

wherein a wedge face and the right face form a right angle along a right wedge edge;

wherein the wedge face and the left face form a right angle along a left wedge edge; and a back face angle edge formed by a line of contact between the wedge face and the back face.

2. The door tool of claim 1, further comprising:

wherein a number of measuring indicia are displayed on the front face of the door tool.

3. The door tool of claim 1, further comprising:

wherein the top point is at approximately a right angle to the front face and the left point is at approximately a right angle to the front face.

4. The door tool of claim 2, further comprising:

wherein the top point is at approximately a right angle to the front face and the left point is at approximately a right angle to the front face.

5. The door tool of claim 1, further comprising:

wherein a hardware setback indicia in displayed on the front face and indicates a plurality of standard measurements for setback distances for door hardware.

6. The door tool of claim 2, further comprising:

wherein a hardware setback indicia in displayed on the front face and indicates a plurality of standard measurements for setback distances for door hardware.

7. The door tool of claim 3, further comprising:

wherein a hardware setback indicia in displayed on the front face and indicates a plurality of standard measurements for setback distances for door hardware.

8. The door tool of claim 4, further comprising:

wherein a hardware setback indicia in displayed on the front face and indicates a plurality of standard measurements for setback distances for door hardware.

9. The door tool of claim 1, further comprising:

wherein an exterior door width indicia and an interior door width indicia are displayed on the front face and indicate a plurality of standard measurements for door widths.

10. The door tool of claim 2, further comprising:

wherein an exterior door width indicia and an interior door width indicia are displayed on the front face and indicate a plurality of standard measurements for door widths.

11. The door tool of claim 3, further comprising:

wherein an exterior door width indicia and an interior door width indicia are displayed on the front face and indicate a plurality of standard measurements for door widths.

12. The door tool of claim 4, further comprising:

wherein an exterior door width indicia and an interior door width indicia are displayed on the front face and indicate a plurality of standard measurements for door widths.

13. The door tool of claim 5, further comprising:

wherein an exterior door width indicia and an interior door width indicia are displayed on the front face and indicate a plurality of standard measurements for door widths.

14. The door tool of claim 1, further comprising:

wherein the top point is designed to be placed under an object to be lifted, the wedge face is placed on a surface, and a user can press down on the top front face at approximately a corner formed by the bottom edge meeting the right edge, thereby causing the top point to lift upwards from the surface and raise the object.

15. The door tool of claim 2, further comprising:

wherein the top point is designed to be placed under an object to be lifted, the wedge face is placed on a surface, and a user can press down on the top front face at approximately a corner formed by the bottom edge meeting the right edge, thereby causing the top point to lift upwards from the surface and raise the object.

16. The door tool of claim 3, further comprising:

wherein the top point is designed to be placed under an object to be lifted, the wedge face is placed on a surface, and a user can press down on the top front face at approximately a corner formed by the bottom edge meeting the right edge, thereby causing the top point to lift upwards from the surface and raise the object.

17. The door tool of claim 5, further comprising:

wherein the top point is designed to be placed under an object to be lifted, the wedge face is placed on a surface, and a user can press down on the top front face at approximately a corner formed by the bottom edge meeting the right edge, thereby causing the top point to lift upwards from the surface and raise the object.

18. The door tool of claim 9, further comprising:

wherein the top point is designed to be placed under an object to be lifted, the wedge face is placed on a surface, and a user can press down on the top front face at approximately a corner formed by the bottom edge meeting the right edge, thereby causing the top point to lift upwards from the surface and raise the object.

19. The door tool of claim 13, further comprising:

wherein the top point is designed to be placed under an object to be lifted, the wedge face is placed on a surface, and a user can press down on the top front face at approximately a corner formed by the bottom edge meeting the right edge, thereby causing the top point to lift upwards from the surface and raise the object.

20. The door tool of claim 19, further comprising:

a hanging means.

* * * * *